United States Patent [19]

Vandame

[11] Patent Number: 4,698,027

[45] Date of Patent: Oct. 6, 1987

[54] MOISTURE-PROOF ELECTRICAL CONNECTOR

[75] Inventor: Bertrand Vandame, Villepreux, France

[73] Assignee: Precision Mecanique Labinal, Bois d'Arcy, France

[21] Appl. No.: 865,018

[22] Filed: May 20, 1986

[30] Foreign Application Priority Data

May 21, 1985 [FR] France ..... 8507630

[51] Int. Cl.[4] ..... H01R 13/52

[52] U.S. Cl. ..... 439/271; 277/207 R; 277/208; 439/272

[58] Field of Search ..... 339/94 R, 94 C, 94 M, 339/60 R, 60 C, 60 M, 61 R, 61 M; 277/207 R, 207 A, 208, 212 R, 212 C; 220/233, 234, 237, 238; 174/77 R; 285/109, 110

[56] References Cited

U.S. PATENT DOCUMENTS

| | | | |
|---|---|---|---|
| 2,615,741 | 10/1952 | Nathan | 277/212 C X |
| 3,266,821 | 8/1966 | Safford | 285/110 X |
| 3,594,696 | 7/1971 | Witek | 339/60 |
| 3,792,416 | 2/1974 | Moulin | 174/77 R X |
| 4,443,047 | 4/1984 | Hofman | 339/26 |
| 4,621,883 | 11/1986 | Noguchi | 339/94 M X |

FOREIGN PATENT DOCUMENTS

| | | | |
|---|---|---|---|
| 1443193 | 7/1976 | United Kingdom | 339/59 M |
| 2034131 | 5/1980 | United Kingdom | 339/94 C |
| A-2130026 | 5/1984 | United Kingdom . | |

OTHER PUBLICATIONS

Tech. Brief: "Inexpensive Electrical Connector is Moisture and Corrosion Proof"—*Semiconductor Products and Solid State Tech.,* vol. 9, No. 11, Nov. 1986, p. 22.

*Primary Examiner*—Eugene F. Desmond
*Assistant Examiner*—Steven C. Bishop
*Attorney, Agent, or Firm*—Sandler & Greenblum

[57] ABSTRACT

A joint for establishing a substantially waterproof and tight electrical connection between two electrical connecting members is provided. The joint comprises two casing sections housing a male member and a corresponding female member into which the male member is adapted to be inserted, each of the members having an electrical conductor attached thereto and each having a portion thereof embedded within one end of a block of insulating material. Free ends of the respective blocks are adapted to face one another in substantial alignment, and the male and female members are positioned within the block and are retained in each of the casing sections. The joint is a substantially moisture-tight and pliable plastic material within which an axial conduit or bore is provided, which bore is adapted to be engaged around the exterior of the female mamber. The compressible joint includes substantially concave ends, each of which forms a substantially cup- or dish-shaped surface adapted to abut one end of a respective insulating block or an interior shoudler of one of the casing sections.

23 Claims, 10 Drawing Figures

MOISTURE-PROOF ELECTRICAL CONNECTOR

BACKGROUND OF THE DISCLOSURE

1. Field of the Invention

The present invention generally relates to moisture-proof or moisture tight electrical connectos, and more specifically to a connector having a compressible joint element used to achieve moisture-proof and tight connections.

2. Discussion of Prior Art

Conventional electrical connectors can comprise, e.g., two complementary casing sections which support the electrical connecting members. Each of the casing sections can be provided with means for insuring that the connecting elements will be held tight to each other when they are assembled. Such connectors are often complicated, costly and are often efficient.

Accordingly, on eof the objects of the present invention is to provide a new and improved moisture-proof or moisture-tight electrical connection in which the casings only serve a secondary purpose, and which are therefore less costly and much more effective than conventional electrical connectors.

SUMMARY OF THE INVENTION

The connection, joint or union formed in accordance with the present invention is designed to provide a tight or moisture-proof electrical connection between at least two connecting members which comprise, e.g., a male member and a complementary female member. Each of the connecting members is fastened to an electrical element, e.g., an electrical conductor, and is also connected tightly to an element having a bearing face. The bearing faces of the two elements are, in turn, designed to be turned with respect to each other. Means are provided to hold the male and female member so that one is engaged within the other, the holding means comprising a fluid-tight, elastic and pliable component which has at least one axial conduit drilled therein. This enables the male member to be engaged within the female member; and the component is provided with concave ends, each of which forms a substantially cup-like configuration. In this fashion the genearlly concave ends are adapted to cooperate with the bearing faces of the two elements when the component is compressed.

In this fashion, after an electrical component formed in accordance with the present invention is positioned on the female member, engagement of the male member within the female member only requires that the bearing faces of the elements will compress the resilient component so that the cup shaped ends of the resilient component will be forced against the bearing faces of the connecting members so as to create an effective and efficient sealing action. It is also possible, under certain circumstances, to provide a simple device which will retain the members in a desired position after they are brought together, insofar as the casings provided for each of the members will not of themselves provide a moisture-proof and tight connection as in conventional electrical connectors.

According to another feature of the invention, the elastic component comprises at least one groove positioned about its periphery.

The present invention also provides for a moisture-proof connector which utilizes a joint as defined hereinabove of the type comprising two complementary casing elements, each casing element housing a complementary-configured assembly device. One of the casing sections is adapted to receive a male member and the other casing member is adapted to receive a female member. When the elements are paired together the component which is used to join the two member will be compressed to a predetermined extent.

This type of connector is simpler and less troublesome to produce than prior art electrical connectors. By virtue of the present invention, it is possible to provide moisture-proof electrical connectors in which electrical conductors are included which can be extended in a direction generally transverse to the socket of a female electrical connector or the plug of a male electrical connector; this is otherwise difficult to achieve, as conventional connectors require multiple sealing joints which are necessarily provided in wiring assemblies.

According to one embodiment of the present invention, each casing or housing is designed to receive a unit of insulating material within which an electrical connecting member is at least partially embedded. The bearing faces referred to above are formed on the ends of the insulating units themselves.

In a second embodiment of the present invention, each casing section or element comprises means for receiving a joint in order to ensure that the electrical elements therein will be maintained in water tight condition. In such a case, each of the casing sections of the connector will include a shoulder which forms a bearing face to bear against the corresponding against one cup-shaped end of the elastic component.

In order to facilitate positioning and holding the joint within one of the casig sections when the elements are still unassembled, the connector will have at least one projection on an interior surface adapted to be inserted within at last one groove in the elastic component.

The present invention is provided for in one aspect thereof by an electrical connector for providing a moistureproof electrical connection between at least two connecting elements. The connector comprises a male member and a female member adapted to receive said male member, each of said members being attached to an electrical conductor, each of said members being further attached to a unit having a bearing surface. The bearing surfaces of each unit are adapted to turn with respect to each other. The apparatus further comprises means for retaining the male and female members in an engaged condition, and the connector furthe comprises an elastic, pliable fluid-tight component. The component has at least one axial bore extending therethrough, said bore being adapted to be engaged about an exterior surface of said female member. The component has first and second concave ends, each of said concave ends forming a substantially cup-shaped surface, said first and second ends of said component being adapted to abut said bearing surfaces of said units when a predetermined compression is exerted on said component.

The component comprises at last one groove, and each of said grooves can be substantially annular. First and second complementary-configured casing sections are also provided, a first one of said casing sections being adapted to receive said male member, a second one of said casing sections being adapted to receive said female member, said casing sections being further adapted to be inserted and engaged within each other so as to comprise means for exerting a predetermined pressure on said pliable component. Each of said casing sections is adapted to receive on of the units, each unit comprising a block of insulating material, each of said bearing faces being located along an end of one of said blocks. One of said electrical conductors is at least partially embedded within each of said insluating blocks, and each of said casing sections is adapted to receive a resilient packing joint for tightly receiving and retaining one of said electrical conductors, each of said casing sections comprising at least one shoulder forming one of said bearing faces, said shoulders being adapted to abut one said component ends when said component is compressed.

One of said casing sections will comprise at least one projection along an internal bore of said casing section which is adapted to cooperate with one of said annular grooves in said components.

The present invention is provided for in a second aspect thereof by a connecting joint formed of resilient, elastic and flexible material, said joint having a substantially arcuate body and first and second concave ends, said body having at least one peripheral groove adjacent one of said ends, said joint being compressible and further comprising at least one axial passage extending from said first end through said body and through said second end. Each of said first and second ends can be substantially dish-shaped or cup-shaped, and two grooves can be provided about the periphery of the joint, one adjacent each of said first and second ends. Each of said grooves can be substantially annular, and the joint can comprise a plurality of substantially parallel bores extending from said first end to said second end.

The present invention is provided for in a third aspect thereof by a substantially waterproof electrical connector which comprises a first casing section having a central bore therein, said first casing section having a substantially open first end and a second substantially closed end having a central aperture therein, and a second casing section having a substantially open first end and a substantially closed second end. The substantially closed second end of said second casing section has a central aperture. First and second blocks of insulating material are positioned within each of said first and second casing sections, respectively, and an electrically conductive element is associated with each of said first and second casing sections, said electrically conductive elements extending through the aperturs in the second ends of respective casing sections, and through a central bore in each of said insulating blocks of material. The conductive elements terminate in conductive male plug and female socket elements, respectively. The connector also includes a substantially compressible elastic joint member having first and second ends and a substantially axial bore extending between said first and second ends, said bore of said compressible member being positioned about and engaged on the exterior surface of said female socket member. Locking means are located along the exterior surfaces of said first and second casing sections for selectively locking said first and second casing sections to each other to compress said elastic joint.

The second casing section comprises an inwardly directed protuberance adapted to engage a peripheral groove on said compressible joint, said groove and said protuberance comprising means for retaining said compressible member within said second casing section, both when said two casing sections are unassembled and when said two casing sections are assembled. The locking means comprises at least one resilient clip having a shoulder, the clip and shoulder being located on the exterior surface of said second casing section, and at least one abutment extending outwardly from an exterior surface of said first casing section, wherein said resilient clip is adapted to be positioned between said exterior surface of said first casing section and said abutment so that one edge of said abutment and said shoulder will engage each other to lock said first and second casing sections together.

Each of said first and second insulating blocks of material includes a bearing surface facing towards respective open ends of said first and second casing sections, and wherein said first and second ends of said compressible joint are adapted to engage bearing surfaces of said first and second insulating blocks when said first and second casing sections are locked together.

Each of said insulating blocks of material and each of said casing sections comprise a relatively narrow neck portion, the neck portions of respective insulating blocks being positioned within the larger diameter neck portions of said casing sections. The compressible joint member has a substantially cylindrical exterior surface with two substantially annular grooves positioned adjacent two ends of said joint, each of said joint ends being substantially concave and cup-shaped. The compressible joint members can be substantially oval in cross-section, and can have two substantially ovular grooves adjacent said first and second ends of said compresible joint, each of said first and second ends of said compresible joint being substantially concave and dish-shaped, said compressible joint having a plurality of substantially parallel axial bores extending between said first and second joint ends.

The second casing section includes a first axial portion and a second portion substantially transverse to said first axial portion, wherein said locking means are located on said first axial portion of said second casing section, and said aperture in said second end is located on said second portion of said second casing section. A plurality of insulating blocks are positioned adjacent to each other within each of said casing sections, each of said casing sections having a plurality of openigns on a front face thereof, each of said casing openings being adapted to be aligned with corresponding bores in each of said insulating blocks, each of said insulating blocks being adapted to receive an electrical conductor and either a male plug or a female socket adapted to receive said male plug.

The present invention is provided for in yet another aspect by a substantially watertight electrical connection comprising first and second casing sections, each of said first and second casing sections having first open ends, second substantially closed ends with apertures therein, and a central bore, said bore having a substantially narrow neck portion adjacent a midpoint thereof of each of said casing sections. A conductive element positioned within respective bores of each of said first and second casing sections, each of said conductive elements comprising a conductive wire and a sheath retained within a flexible sealing member which substantially fixedly retains said conductive element within one end of said central bore, said conductive element having a bare free end retained via crimping in a terminal, the terminal in said second casing section being attached to a female socket, and the terminal in said first casing section terminating in a male plug, said male plug being adapted to be inserted within said femal member when said first and second casing sections are locked together. A subtantially tubular, compressible joint member has at least one central bore, said at least one central bore being adapted to be positioned and engaged about the exterior surface of said female bushing.

Locking means are located on the exterior surface of said first and second casing sections for selectively locking said first and second casing sections to each other. The compressible element has first and second substantially concave ends, at least one groove located about the periphery of said compresibel joint, said first end of said compressible joint being positioned against a substantially annular shoulder within said second casing section, said second end of said compressible joint being substantially free when said first and second casing sections are unassembled. The second casing section comprises at last one interior protuberance, said protuberance adapted to fit within said groove on said compresible joint to lock said compressible joint within a first end of said second casing section both when said first and second casing sections are locked and when said first and second casing sections are unassembled.

The first casing also comprises at least one internal shoulder, said second end of said compressible joint being adapted to abut and engage said first casing section shoulder when said first and second casing sections are locked to each other.

The male member comprises at least one resilient locking tab adapted to engage an internal shoulder of said first casing section, and said locking means comprise at least one resilient lug attached to an exterior surface of said second casing section and at last one abutment attached to an exterior surface of said first casing section, wherein each of said resilient lugs is adapted to be compressed between said abutment and the exterior surface of said first casing section, said lug having an outwardly directed shoulder adapted to engage an edge of said abutment to lock said first and second csing sections to each other.

BRIEF DESCRIPTION OF THE DRAWINGS

The above and other objects, features and advantages of the present invention will be described in greater detail hereinafter with reference to the specific embodiments which are represented in the accompanying drawings, in which like reference numerals are used to describe like parts throughout, and wherein.

DETAILED DESCRIPTION OF THE DRAWINGS

Figure 1:
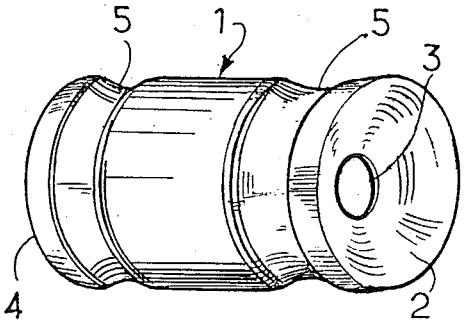
FIG. 1 is a perspective view of a first embodiment of a compressible joint used to provide moisture-proof and/or tight electrical connectors.

The joint or connector illustrated in FIG. 1 is a resilient, substantially cylindrical compressible joint member having an axial passageway or bore 3 drilled therein from a first end 2 towards a second end 4. Each of the ends are concave and form substantially cup-shaped areas.

Member 1 can comprise, e.g., two generally annular grooves 5; and the member is adapted to ensure tightness between connecting elements 6 and 7. Connecting element 6 is formed by a connecting member 11 having an extending male plug 8 which is attached to one end of an electrical conductor 9 housed within an insulating sheath 10. A part of connecting member 11 is embedded, together with one end of conductor 9, within a block of insulating material 12, e.g., synthetic plastic material.

A second electrical connecting element 7 comprises a connecting member 14 which terminates at one end in a female socket 13 which is adapted to receive a male plug 8. The other end of connecting member 14 is attached to an electrical conductor 15 which is covered or housed by an insulating sheath 16. Parts of connecting member 14 and electrical conductor 15 are embedded within insulating block 17, as best seen in FIG. 1, and insulating block 17 is preferably formed from a synthetic plastic material.

Cylindrical member 1 is formed from an elastic, pliable, and compressible material which is impervious to liquid, and which comprises e.g., an elastomer; the elastic material comprising cylindrical member 1 is also an insulating material.

Insulating block 12 has one flat face or surface 18 located in a plane which is substantially perpendicular to the axis of plug 8.

Insulating block 17 has at least one flat face 19 which is disposed along a plane substantially perpendicular to the axis of femal socket 13. Faces 18 and 19 thus constitute bearing surfaces for first and second ends 2 and 4 of cylindrical member 1; the faces and ends abut each other when casing sections 21 and 29 are attached.

Attached to block 12 is a first casing section 21 (FIG. 1); the casing section can be formed, e.g., from two portions which are hinged together or which can be assembled or attached to each other in any suitable fashion. Casing section 21 comprises a base wall 22 in which a central aperture 23 is provided through which conductor 9 can extend.

Insulating block 12 can comprise, e.g., an inwardly directed neck portion 24 with which pins or retaining neck 25 on casing element 21 cooperate. Casing element 21 is has a sleeve extension 27 with two lateral guides or wings 28 extending outwardly from the periphery of sleeve 27. Guides 28 form abutments for engaging shoulders on resilient clips 35.

Second insulating block 17 is positioned within a complementary casing section 29, the second casing section having a base wall 30 in which a central aperture 31 is drilled for permitting passage of conductor 15. This casing section is provided with retaining neck or pins 32 which are adapted to cooperate with the relatively narrow neck 33 of insulating block 17.

Complementary or second casing section 29 also comprises an extension 34 which is adapted to be inserted into the extension portion 27 of casing section 21. Extension 34 is provided with studs or protuberances 37 which are adapted to cooperate with annular groove 5 in cylindrical joit member 1 to hold member 1 in a relatively fixed position within casing section 29 when the casing sections 21 and 29 are in unassembled condition.

Figure 2:
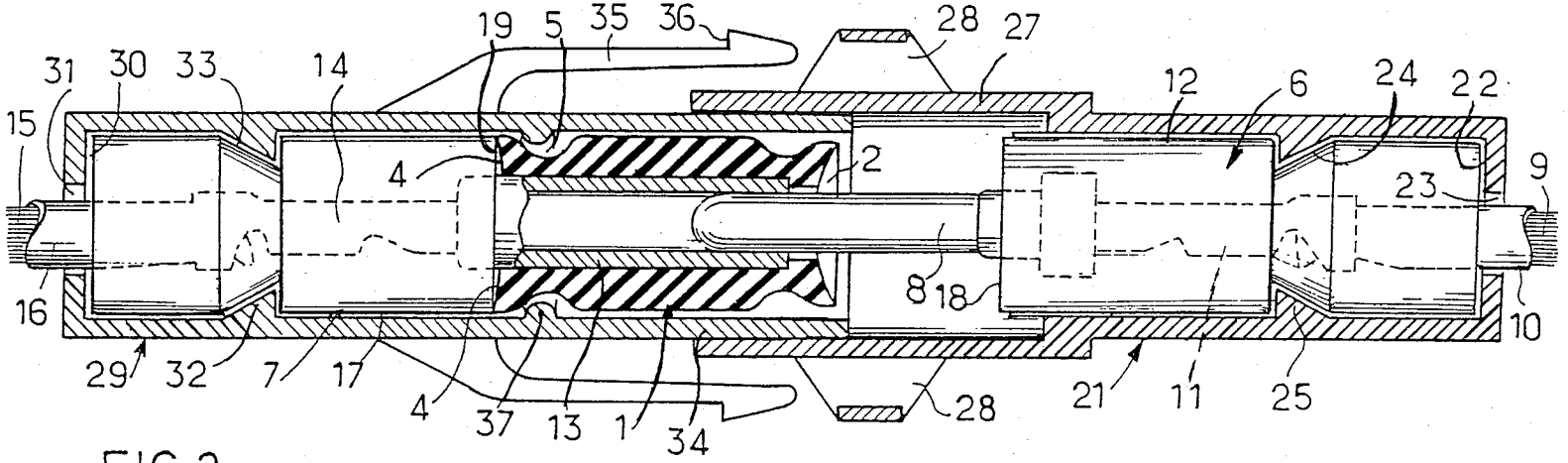
FIG. 2 is a sectional view illustrating a water proof and/or tight electrical connection formed by using the joint of FIG. 1 in which the casing sections are not yet assembled.

Second casing section 29 is provided with two resilient lugs 35, each of which terminates in a free catch or clip 36 having a rearwardly directed shulder (unreferenced), as best illustrated in FIG. 2.

Figure 3:
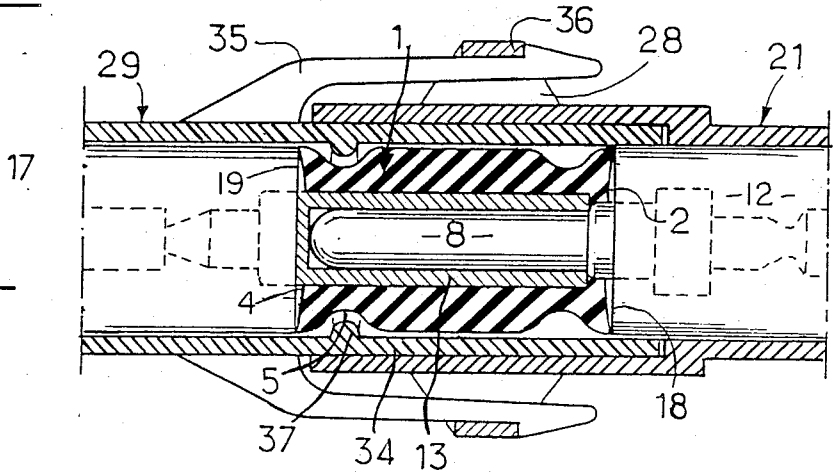
FIG. 3 is an axial cross-sectional view similar to the view in FIG. 2, in which the casing sections have been interconnected.

In order to provide a moisture-proof and sufficiently tight connection, as best seen in FIGS. 2 and 3, member 1 is positioned within extension 34 of second casing section 29, and casing section 21 is then assembled to second casing section 29. This is achieved by forcing resilient catches or clips 36 through the opening in guides 28 so that the rear shoulder of the free ends of the clips will lock against one edge of guides 28, thus assuring locking of casing section 21 to casing section 29. In this locked position, as best illustrated in FIG. 3, cylindrical joint member 1 is slightly flattened by and between bearing surfaces 18 and 19 of blocks 12 and 16, respectively. In this fashion, ends 2 and 4 of the cylindrical member 1 are elastically deformed and ensure a substantially fluid-tight relationship between faces 18 and 19.

As a result, this embodiment of the present invention is relatively simple, as there is no need for the elements themselves to be tightly connected, this function being served by the compressible joint member.

Figure 6:
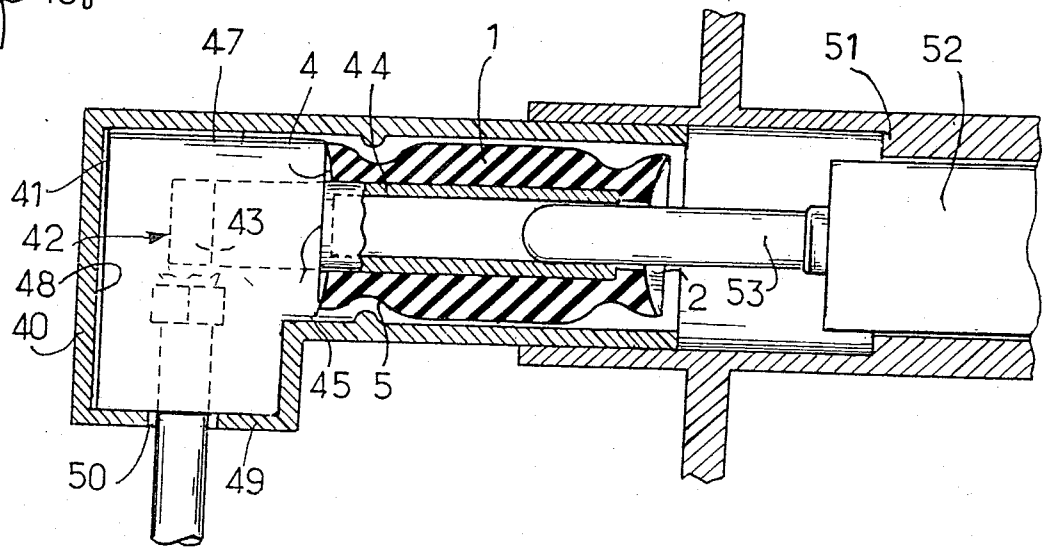
FIG. 6 is a sectional view of the section of FIGS. 4 and 5 when assembled together with a complementary-configured cross section.
Figure 4:
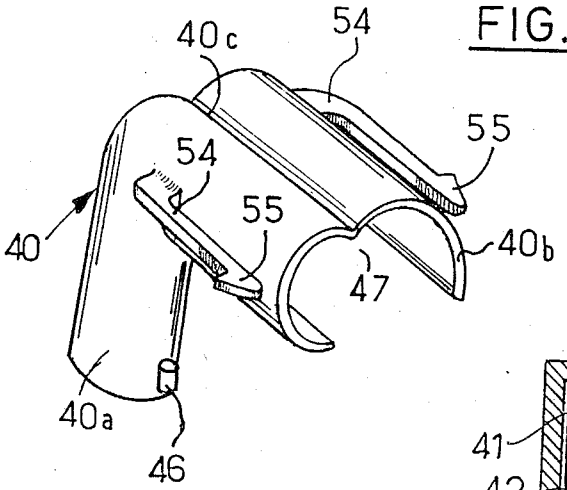
FIG. 4 is a perspective view of an embodiment of a casing section having two transverse portions.
Figure 5:
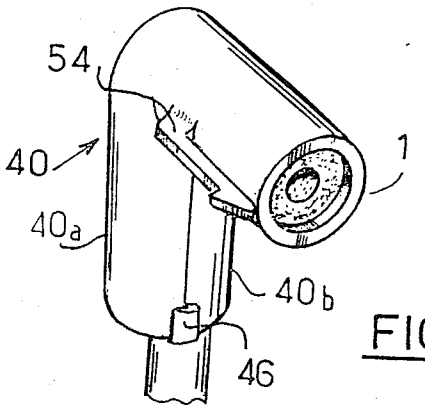
FIG. 5 is a perspective view of the casing section of FIG. 4 when closed.

FIGS. 4–6 of the present application disclose a second embodiment of the present invention. In this embodiment one of the casing sections, e.g., casing section 40, is adapted to fit within an insulating block 41. Within the insulating block a conductor 42 is embedded which is fastened to a lug 43. Attached to the end of the lug is a sleeve 44 which extends perpendicularly of conductor 42. Sleeve 44 extends beyond a second end of block 41, face 45 of which having been finished and having an opening therein.

Casing element 40 is formed from two half-shells 40*a* and 40*b*, as best illustrated in FIG. 4, which are hinged along a hinge line 40*c* and which includes two interacting locking elements 46 (only one of which is shown in FIG. 4) to lock half-shells 40*a* and 40*b* to each other.

Casing section 40 also includes a first part or portion 47 in the form of a longitudinally extending channel and a second part or portion 48, also formed as a channel, the first and second channels extending perpendicularly to each other. At its free end, the second part 48 incorporates a bse 49 within which a central opening or bore 50 is drilled.

As best illustrated in FIG. 6, block 41 is mounted within a second part 48, with face 45 of the block being located rightwardly of portion 48. Member 1 is fitted within part 47, which member is the same as that illustrated in FIG. 1 and which has as end 4 which is adapted to bear against free end or surface 45 of casing section 40.

The external surface of member 47 is adapted to be fit within a complementary-configured casing section 51, as best illustrated in FIG. 6. Second casing section 51 is substantially identical to casing section 21, as shown in FIGS. 2 and 3. Insulating block 52 has a male plug 53 embedded therein which is positioned within casing section 21 and adapted to be inserted into sleeve or female member 44. Block 52 and plug 53 are quite similar to the similar elements illustrated in FIGS. 2 and 3.

Casing section 40 can comprise, e.g., resilient lugs 54 as illustrated in FIGS. 4 and 5, having catches 55 with free shoulders which substantially correspond to previously described lugs 35 and catches 36. Lugs 54 are adapted to cooperate with locking abutments on first casing section 51, in a fashion similar to wings 28 to casing element 21, as illustrated in FIG. 2.

Accordingly, by using the present invention, it is possible to provide a simple, moisture-proof connection having an angle therein, which is otherwise difficult to achieve with more conventional electrical connectors.

Figure 7:
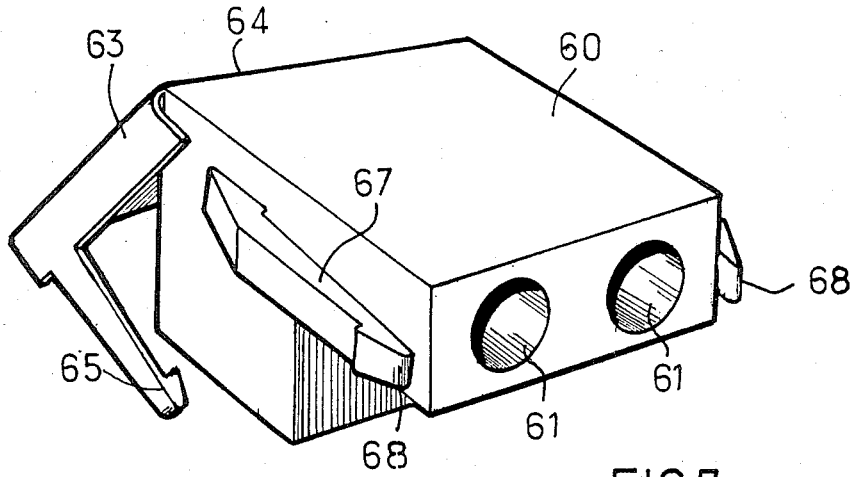
FIG. 7 is a perspective view of yet another embodiment of a casing section in accordance with the present invention.
Figure 8:
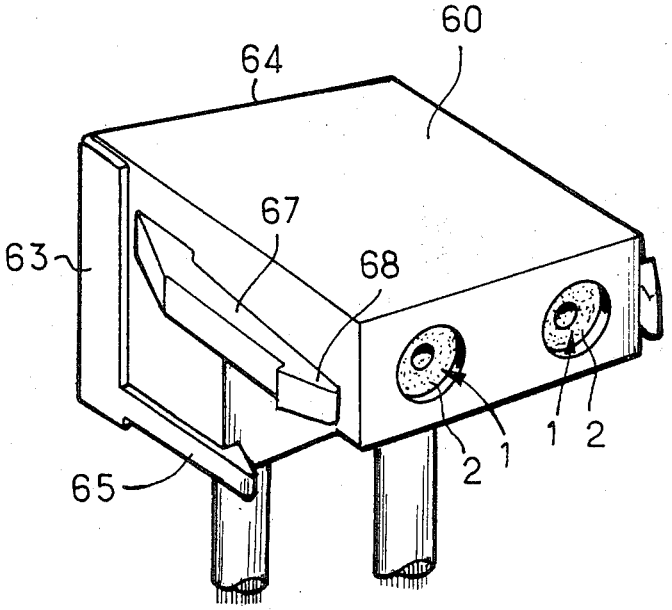
FIG. 8 is a perspective view of the casing section of FIG. 7 positioned about two wires.

Since the housing itself does not have to be moisture-proof in accordance with the present invention, it is possible to use multi-channel assemblies, as illustrated clearly in FIGS. 7 and 8.

As illustrated in these two figures, a right-angled casing section 60 which is adapted to cooperate with a complementary-configured casing section (not illustrated) is provided, within which insulating members 12 or 52, having plugs 8 or 53, respectively, therein, can be provided.

In this fashion, casing section 60 is adapted to receive two units, e.g., two blocks or units 41, and thus comprise two mounting which are disposed on the rear surface of element 60, each of the mountings opening into a substantially channel-shaped member 61 adapted to receive a socket, e.g., socket 44 on which member 1 is engaged.

The rear face of casing section 60 is closed by a pivotable shutter 62, which is hinged along rear edge 64 of casing section 60, and which comprises a locking member 65 adapted to cooperate with the front lower face (unreferenced) of section 60, as illustrated in FIG. 8.

Opposite walls (unreferenced) of casing section 60 are provided with resilient lugs 67, having stops or detents 68 which are adapted to cooperate with guides on a complementary-configured casing section, e.g., with wings similar to wings 28 of casing section 21, as illustrated in FIG. 2.

Figure 9:
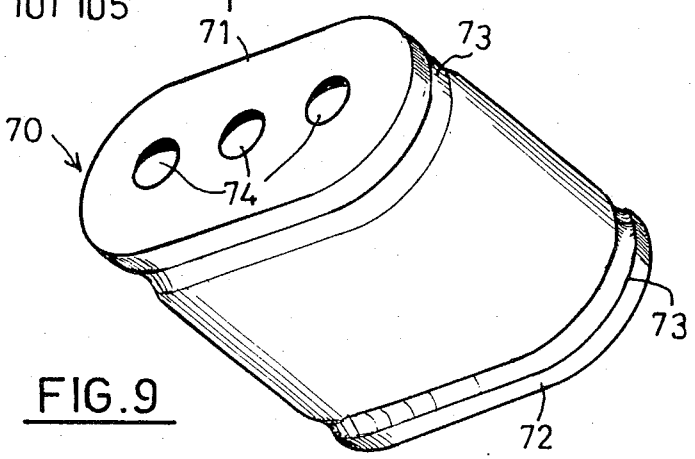
FIG. 9 is a perspective view of another embodiment of a compressible joint formed in accordance with the present invention.

FIG. 9 is a perspective view of a second embodiment of a compressible and flexible joint member formed in accordance with the invention which is adapted to receive a plurality of electrical connections. Joint 70, illustrated in FIG. 8, is formed from a substantially flat or shallow body which has first and second ends 71 and 72; each of these ends comprises a concave portion having a substantially disc-configuration. Member 70 is formed from a flexible and resilient material and includes three substantially equidistant parallel conduits or bores 74 which are each adapted to receive a female socket, e.g., socket 13 or 44, into which male plugs 8 or 53, or a corresponding configuration, will be inserted.

Any housing which is adapted to receive the coupling of FIG. 9 will be adapted to receive three corresponding connecting members.

As in the constructions noted above, member 70 can comprise one or more generally annular grooves 73 for facilitating positioning of the member in a casing or housing section prior to assembly of the housing sections with a complementary-configured housing section, i.e., in their unassembled positions.

Figure 10:
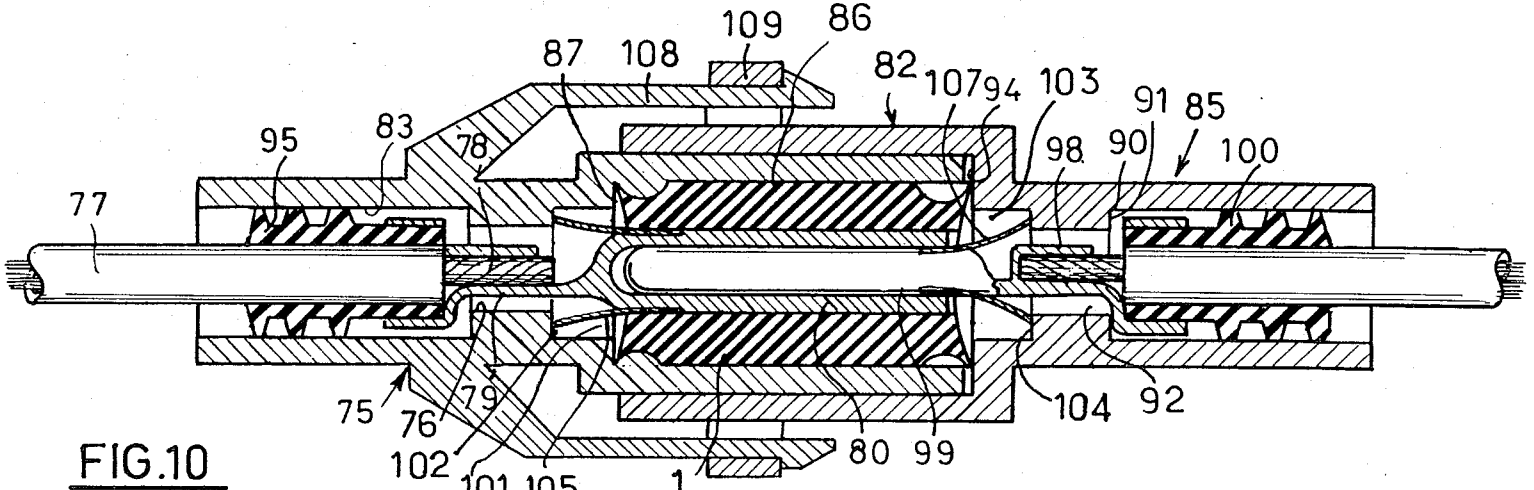
FIG. 10 is an axial cross-sectional view illustrating a modified moisture-proof electrical connector formed in accordance with the present invention.

In the various embodiments which are illustrated in FIGS. 1–8, it has been assumed that connecting elements 11 and 14 or 43 are at least partially embedded within insulating blocks 12, 17 and 41, respectively, and that the insulating blocks include finished faces 18 and 19 against which the cup-shaped ends 2 and 4, respectively, are adapted to bear in order to ensure tightness of the assembly. FIG. 10 illustrated a modified form of the invention in which the connecting members are not partially embedded within insulating blocks.

As illustrated in FIG. 10, housing 82 is provided which is formed from a first casing section 75, and a second complementary casing section 85. The two housing sections are assembled in a suitable fashion, as in the embodiments of FIGS. 2 and 6 discussed above.

Second housing or casing section 75 includes a first passageway 83 which is open at a free end thereof and closed at a second end by a wall 84. An aperture 76 is drilled within the second end of the wall, and opens into a seating area 101 (FIG. 10) which forms, together with holes 76, a shoulder 102, the seating area terminating in an extension 86 which is connected to seating area 101 by shoulder 87.

Complementary first casing section 85 comprises a first portion 90 open at its free-end and closed at a second end adjacent its midpoint by a wall 91; a hole or bore 92 is drilled within wall 91 and opens into seating area 103 having a shoulder 104. Seating area 103 is extended by a skirt portion 93 which is connected to seating area 103 via shoulder 94.

Skirt 93 is adapted to receive casing extension 86, as illustrated in FIG. 10.

Passageway 85 is adapted to receive a sealing joint 95 which is mounted on an insulating sheath for electrical conductor 77. The second end of the electrical conductor is bars and is attached via crimping to terminal 79 of a connecting member having a female bushing or socket 80.

Terminal 79 extends into hole 76; and female connecting member 80 includes resilient holding lugs 105 which are adapted to cooperate with shoulder 102.

A flexible packing joint 100 is seated within part 90 and is mounted on the insulating sheath of conductor 96. The base end 97 of conductor 96 is attached by crimping to terminal 98; the terminal, in turn, is provided with a male plug 99 which is adapted to be inserted into socket 80.

Male plug 99 comprises resilient locking tabs 107 which are adapted to cooperate with shoulder 104.

Housing element 75 comprises resiient lugs 108 which are adapted to cooperate with locking members 109 of element 85 in order to ensure that the two elements of housing 82 will be locked to each other, as in the previously described embodiments of FIGS. 2 and 3.

A compressible unit 1 is positioned within the casing section 75 and about female socket 80, and has one end face 4 cooperating with shoulder 87, the shoulder thus forming a bearing face. The other end 2 of cylindrical member 1 will bear against shoulder 94, which forms a second bearing face in this assembly.

In all of the construction which have been described above, at least two connectors are provided. It is possible, however, to use the coupling in accordance with motor or to a distinct electrical apparatus.

It is further obvious that the present invention is not limited to the constructions which are described and illustrated herein, and that it is equally possible to incorporate herein numerous modifications with respect to detail without departing from the scope of the present invention.

What is claimed is:

1. An electrical connector for providing a moisture-proof electrical connection between at least two connecting elements, said connector comprising a male member and a female member adapted to receive said male member, each of said members being attached to an electrical conductor and being further attached to a unit having a bearing surface, the bearing surfaces of each of said units being adapted to turn with respect to each other, said apparatus further comprising means for retaining said male and female members in an engaged condition, wherein said connector further comprises an elastic, pliable fluid-tight component, said component having at least one axial bore extending there-through, said bore adapted to be engaged about an exterior surface of said female member, said component having first and second concave ends, each of said concave ends forming a substantially cup-shaped surface, said first and second ends of said component being adapted to abut said bearing surfaces of said units when a predetermined compression is exerted on said component.

2. An electrical connector formed in accordance with claim 1 wheein said component comprises at least one groove.

3. An electrical connector formed in accordance with claim 2 wherein said at least one groove is substantially annular.

4. An electrical connector formed in accordance with claim 1 further comprising first and second complementary-configured casing sections, said first casing section being adapted to receive said male member, said second casing section being adapted to receive said female member, said casing sections being further adapted to be inserted and engaged within each other so as to comprise means for exerting a predetermined presure on said pliable component.

5. An electrical connector formed in accordance with claim 4 wherein each of said casing sections is adapted to receive one of said units, each unit comprising a block of insulating material, each of said bearing faces being located along an end of one of said blocks.

6. An electrical connector formed in accordance with claim 5 wherein one of said electrical conductors is at least partially embedded within each of said insulating blocks.

7. An electrical connector formed in accordance with claim 4, wherein each of said casing sections is adapted to receive a resilient packing joint for tightly receiving and retaining one of said electrical conductors, each of said casing sections comprising at last one shoulder forming one of said bearing faces, said shoulders being adapted to abut said component ends when said component is compressed.

8. A moisture-proof electrical connector formed in accordance with claim 4 wherein one of said casing sections comprises at least one projection along an internal bore of said casing section which is adapted to cooperate with an annular groove in said compressible component.

9. A substantially waterproof electrical connector, said electrical connector comprising:

(a) a first casing section having a central bore therein, said first casing section having a substantially open first end and a second substantially closed end having a central aperture therein, and a second casing section having a substantially open first end and a substantially closed second end, said substantially closed second end of said second casing section having a central aperture therein;

(b) first and second blocks of insulating material positioned within each of said first and second casing sections, respectivly;

(c) an electrically conductive element associated with each of said first and second casing sections, said electrically conductive elements extending through the apertures in the second ends of respective casing sections, and through a central bore in each of said insulating blocks of material, said conductive elements terminating in conductive male plug and female socket elements, respectively;

(d) a substantially compressible elastic joint having first and second ends and a substantially axial bore extending between said first and second ends, said bore of said compressible member being positioned about and engaged on an exterior surface of said female socket member; and (e) locking means located along exterior surfaces of said first and second casing sections for selectively locking said first and second casing sections to each other and to compress said elastic joint.

10. A waterproof electrical connector formed in accordance with claim 9 wherein said second casing section includes an inwardly directed protuberance adapted to engage a peripheral groove on said compresible joint, said groove and said protuberance comprising means for retaining said compressible member within said second casing section both when said two casing sections are unassembled and when said two casing sections are assembled.

11. A waterproof electrical connector formed in accordance with claim 9, wherein said locking means comprises at least one resilient clip having a shoulder, said clip and shoulder being located on the exterior surface of said second casing section and at least one abutment extending outwardly from the exterior surface of said first casing section, wherein said resilient clip is adapted to be positioned between said exterior surface of said first casing section and said abutment so that one edge of said abutment and said shoulder willengage each other to lock said first and second casing sections together.

12. A waterproof electrical connector formed in accordance with claim 11, wherein each of said first and second insulating blocks of material includes a bearing surface facing towards respective open ends of said first and second casing sections, and wheein said first and second ends of said compressible joint are adapted to engage the bearing surfaces of said first and second insulating blocks when said first and second casing sections are locked together.

13. A waterproof electrical connector formed in accordance with claim 9, wherein each of said insulating blocks of material and each of said casing sections include a narrow neck portion, the neck portions respective insulating blocks being positioned within the larger diameter neck portions of said casing sections.

14. A waterproof electrical connector formed in accordance with claim 9 wherein said compressible joint has a substantially cylindrical exterior surface with two substantially annular grooves positioned adjacent two ends of said joint, each of said joint ends being substantially concave and cup-shaped.

15. A watertight electrical connector formed in accordance with claim 9 wherein said compressible joint is substantially oval in cross-section and has two substantially oval grooves adjacent first and second ends of said compressible joint, each of said first and second ends of said compresible joint being substantially concave and dish-shaped, said compressible joint having a plurality of substantially parallel axial bores extending between said first and second ends of said compression joint.

16. A watertight electrical connector formed in accordance with claim 9 wherein said second casing section includes a first axial portion and a second portion substantially transverse to said first axial portion, wherein said locking means are located on said first axial portion of said second casing section and said aperture in said second end is located on said second portion of sai second casing section.

17. A watertight electrial connector formed in accordance with claim 9, wherein plurality of insulating blocks are positioned adjacent to each other within each of said casing sections, each of said casing sections having a plurality of openigns on a front face thereof, each of said casing openings being adapted to be aligned with corresponding bores in each of said insulating blocks, each of said insulating blocks being adapted to receive an electrical conductor and either a mail plug or a female socket adapted to receive said male plug.

18. A substantially water tight electrical connection comprising:

(a) first and second casing sections, each of said first and second casing sections having first pen ends, second substantially closed ends with apertures therein, and a central bore, said central bore having a relatively narrow neck portion adjacent a midpoint of each of said casing sections;

(b) a conductive element positioned within respective bores of each of said first and second casing sections, each of said conductive elements comprising a conductive wire and a sheath retained with a flexible sealing member which substantially fixedly retains said conductive element within one end of said central bore, said conductive element having a bare free end retained via crimping in a terminal, the terminal in said second casing section being attached to a female socket, and the terminal in said first casing section terminating in a male plug, said male plug being adapted to be inserted within said female member when said first and second casing sections are locked together;

(c) a substantially tubular, compressible joint member having at last one central bore, said at least one central bore adapted to be positioned and engaged about the exterior surface of said female bushing; and (d) locking means located on the exterior surface of said first and second casing sections for selectively locking said first and second casing sections to each other.

19. A waterproof electrical connection formed in accordance with claim 18 wherein said compressible joint has first and second substantially concave ends, at least one groove located about the periphery of said compressible joint, said first end of said compressible joint being positioned against a substantially annular shoulder within said second casing section, said second end of said compressible joint being substantially free when said first and second casing sections are unassembled.

20. A waterproof electrical connector formed in accordance with claim 19 wherein said second casing section comprises at last one interior protuberance, said protuberance adapted to fit within said groove on said compressible joint to lock said compressible joint wihtin a first end of said second casing section both when said first and second casing sections are locked and when said first and second casing sections are unassembled.

21. A waterproof electrical connector formed in accordance with claim 20 wherein said first casing comprises at least one internal shoulder, said second end of said compressible joint being adapted to abut and engage said first casing section shoulder when said first and second casing sections are locked to each other.

22. A waterproof electrical connector formed in accordance with claim 8, wherein said male member comprises at least one resilient locking tab adapted to engage an internal shoulder of said first casing section.

23. A waterproof electrical connector formed in accordance with claim 8 wherein said locking means comprise at least one resilient lug attached to an exterior surface of said second casing section and at least one abutment attached to an exterior surface of said first casing section, wherein each said resilient lug is adapted to be compressed between said abutment and the exterior surface of said first casing section, said lug having an outwardly directed shoulder adapted to engage an edge of said abutment to lock said first and second casing sections to each other.

* * * * *

UNITED STATES PATENT AND TRADEMARK OFFICE

CERTIFICATE OF CORRECTION

PATENT NO. : 4,698,027

DATED : October 6, 1987

INVENTOR(S) : Bertrand VANDAME

It is certified that error appears in the above-identified patent and that said Letters Patent is hereby corrected as shown below:

In the Abstract, line 16 of the printed patent, change "mamber" to ---member---.
At column 1, line 19 of the printed patent, change "on eof" to ---one of---.
At column 2, line 33 of the printed patent, change "casig" to ---casing---.
At column 2, line 39 of the printed patent, change "moistureproof" to ---moisture-proof---.
At column 2, line 48 of the printed patent, change "furthe" to ---further---.
At column 2, line 68 of the printed patent, change "on" to ---one---.
At column 3, line 4 of the printed patent, change "insluating" to ---insulating---.
At column 3, line 46 of the printed patent, change "aperturs" to ---apertures---.
At column 4, line 42 of the printed patent, change "openigns" to ---openings---.
At column 4, line 67 of the printed patent, change "femal" to ---female---.
At column 5, line 10 of the printed patent, change "compresibel" to ---compressible---.
At column 5, line 38 of the printed patent, change "csing" to ---casing---.
At column 6, line 46 of the printed patent, change "femal" to ---female---.
At column 7, line 8 of the printed patent, change "joit" to ---joint---.

UNITED STATES PATENT AND TRADEMARK OFFICE

CERTIFICATE OF CORRECTION

PATENT NO. : 4,698,027

DATED : October 6, 1987

INVENTOR(S) : Bertrand VANDAME

It is certified that error appears in the above-identified patent and that said Letters Patent is hereby corrected as shown below:

At column 7, line 14 of the printed patent, change "shulder" to ---shoulder---.
At column 7, line 33 of the printed patent, insert --- and includes two casing sections which are also relatively simple,--- after "relatively simple,".
At column 9, line 34 of the printed patent, change "bars" to ---bare---.
At column 9, line 48 of the printed patent, change "resiient" to ---resilient---.
At column 9, line 59 of the printed patent, change "construction" to ---constructions---.
At column 9, lines 61 and 62 of the printed patent, insert ---the present invention to connect one or more conductors to a --- after "in accordance with".
At column 10, line 24 of the printed patent (claim 2, line 2), change "wheein" to ---wherein---.
At column 10, line 51 of the printed patent (claim 7, line 5), change "last" to ---least---.
At column 11, line 5 of the printed patent (claim 9, line 13), change "respectivly" to ---respectively---.
At column 11, lines 42 and 43 of the printed patent (claim 11, lines 10-11), change "willengage" to --- will engage---.
At column 11, line 49 of the printed patent (claim 12, line 5), change "wheein" to ---wherein---.
At column 12, line 15 of the printed patent (claim 16, line 8), change "sai" to ---said---.
At column 12, line 16 of the printed patent (claim 17,

UNITED STATES PATENT AND TRADEMARK OFFICE

CERTIFICATE OF CORRECTION

PATENT NO. : 4,698,027

DATED : October 6, 1987

INVENTOR(S) : Bertrand VANDAME

It is certified that error appears in the above-identified patent and that said Letters Patent is hereby corrected as shown below:

line 1), change "electrial" to ---electrical---.
At column 12, line 17 of the printed patent (claim 17, line 2), insert ---a --- after "wherein".
At column 12, line 20 of the printed patent (claim 17, line 5), change "openigns" to ---openings---.
At column 12, line 29 of the printed patent (claim 18, line 4), change "pen" to ---open---.
At column 12, line 37 of the printed patent (claim 18, line 12), change "with" to ---within---.
At column 6, line 60 of the printed patent, delete "is" after "21".
At column 8, line 29 of the printed patent, change "mounting" to ---mountings---.

Signed and Sealed this

Second Day of August, 1988

*Attest:*

*Attesting Officer*

DONALD J. QUIGG

*Commissioner of Patents and Trademarks*